US007097428B2

(12) United States Patent
Barb et al.

(10) Patent No.: US 7,097,428 B2
(45) Date of Patent: Aug. 29, 2006

(54) INTEGRAL COVER BUCKET DESIGN

(75) Inventors: Kevin Joseph Barb, Halfmoon, NY (US); Douglas Carl Hofer, Clifton Park, NY (US); Amir Mujezinovic, Guilderland, NY (US); Leonid Yulyevich Ginessin, Moscow (RU)

(73) Assignee: General Electric Company, Schenectady, NY (US)

( * ) Notice: Subject to any disclaimer, the term of this patent is extended or adjusted under 35 U.S.C. 154(b) by 85 days.

(21) Appl. No.: 10/873,145

(22) Filed: Jun. 23, 2004

(65) Prior Publication Data

US 2005/0287004 A1 Dec. 29, 2005

(51) Int. Cl.
*F03B 3/12* (2006.01)

(52) U.S. Cl. ..... 416/191; 416/192; 416/195

(58) Field of Classification Search ..... 416/189, 416/190, 191, 192, 194, 195, 196 R
See application file for complete search history.

(56) References Cited

U.S. PATENT DOCUMENTS 5,261,785 A * 11/1993 Williams ..... 415/169.2
5,509,784 A 4/1996 Caruso et al.
6,679,681 B1 1/2004 Burnett et al.

* cited by examiner

*Primary Examiner*—Edward K. Look
*Assistant Examiner*—Dwayne J White
(74) *Attorney, Agent, or Firm*—Nixon & Vanderhye P.C.

(57) ABSTRACT

A bucket for use on a steam turbine rotor wheel, the bucket comprising a shank portion and an airfoil portion, the airfoil portion having a radially outer tip with a tip cover adapted to be engaged, in use, by a similar tip cover on an adjacent bucket, wherein a radial step is formed in the tip cover and the airfoil portion along a leading edge of the airfoil portion.

7 Claims, 3 Drawing Sheets

INTEGRAL COVER BUCKET DESIGN

BACKGROUND OF THE INVENTION

This invention relates to steam turbines and more specifically, to the design of last-stage steam turbine buckets with integral covers.

The tip areas of last-stage steam turbine buckets or blades with integral covers operate in a wet steam condition, typically with supersonic relative velocity between the steam flow and the buckets. The action of high speed, wet steam flow on the buckets can produce erosion, and can contribute to corrosion damage of the metal surfaces in the tip areas. The covers between adjacent buckets contact each other during operation by virtue of the bucket's rotation caused by the untwisting effect of the applied centrifugal forces. Connection or contact of the integrally covered buckets during operating conditions enhances the rigidity of the bucket structure and improves vibration damping. The presence of moisture on these contact areas can contribute to stress corrosion cracking. The design of the last stage bucket, therefore, must be tolerant of wet steam in existing environmental conditions. Moreover, any flow disturbing elements at the bucket tip region must be avoided to minimize aerodynamic losses.

The tip bucket design for certain last stage turbine buckets results in a pocket area (or simply, pocket) being formed between adjacent bucket tip covers that tends to trap moisture produced by adjacent surfaces of the bucket covers and leading and trailing edges of the adjacent airfoils. The trapped moisture in the pocket area can cause damage to the buckets themselves as well as the damping contact surfaces of the covers.

BRIEF DESCRIPTION OF THE INVENTION

The present invention identifies an improved bucket tip and cover shape that avoids erosion and corrosion of the steam turbine bucket and reduce aerodynamic losses, thus improving the reliability and efficiency of the steam turbine. This design change is achieved without impacting other features that are critical to the performance of the turbine and reliability of the bucket.

In an exemplary embodiment, the last stage turbine buckets have integral covers disposed at the tip of the buckets that are generally similar to the known covers, but with a subtle yet significant shape change as further described below. To solve the problems experienced with the existing cover design, the cover has been modified to the extent that a radial step is formed between the airfoil leading edge tip and the cover top surface that eliminates the above-described pocket area, thus reducing moisture entrapment potential and also reducing aerodynamic drag force or aerodynamic losses. In one variant, the radial surface portion of the step is curved toward the adjacent bucket cover surface. In a second variant, the radial surface portion of the step is curved more severely to substantially smoothly merge with the adjacent bucket cover surface. The precise shape of the step may be optimized to balance the stress level, addition of mass and the impact on the aerodynamic design.

Accordingly, in one aspect, the invention provides a bucket for use on a steam turbine rotor wheel, the bucket comprising a shank portion and an airfoil portion, the airfoil portion having a radially outer tip with a tip cover adapted to be engaged, in use, by a similar tip cover on an adjacent bucket, wherein a radial step is formed in the tip cover and the airfoil portion along a leading edge of the airfoil portion.

In another aspect, the invention provides a bucket for use on a steam turbine rotor wheel, the bucket comprising a shank portion and an airfoil portion, the airfoil portion having a radially outer tip with a tip cover adapted to be engaged, in use, by a similar tip cover on an adjacent bucket, wherein a radial step is formed in the tip cover and the airfoil portion along a leading edge of the airfoil portion; wherein the step is formed by a first airfoil surface extending in a flow direction away from the leading edge and a second tip cover surface extending radially away from the first airfoil surface; and wherein the leading edge is radially shortened by forming the radial step; and further wherein the tip cover is integral with the airfoil portion.

In still another aspect, the invention provides a method of eliminating a moisture-trapping pocket between adjacent top covers at radially outer ends of respective airfoil portions of turbine buckets comprising: a) radially shortening leading edges of the turbine buckets to create radial steps between the leading edges and top surfaces of the tip covers; and b) cutting radial surface portions of the radial steps such that the radial surface portions more smoothly merge with adjacent radial surfaces at trailing edges of adjacent buckets.

The invention will now be described in detail in connection with the drawings identified below.

DETAILED DESCRIPTION OF THE INVENTION

Figure 1:
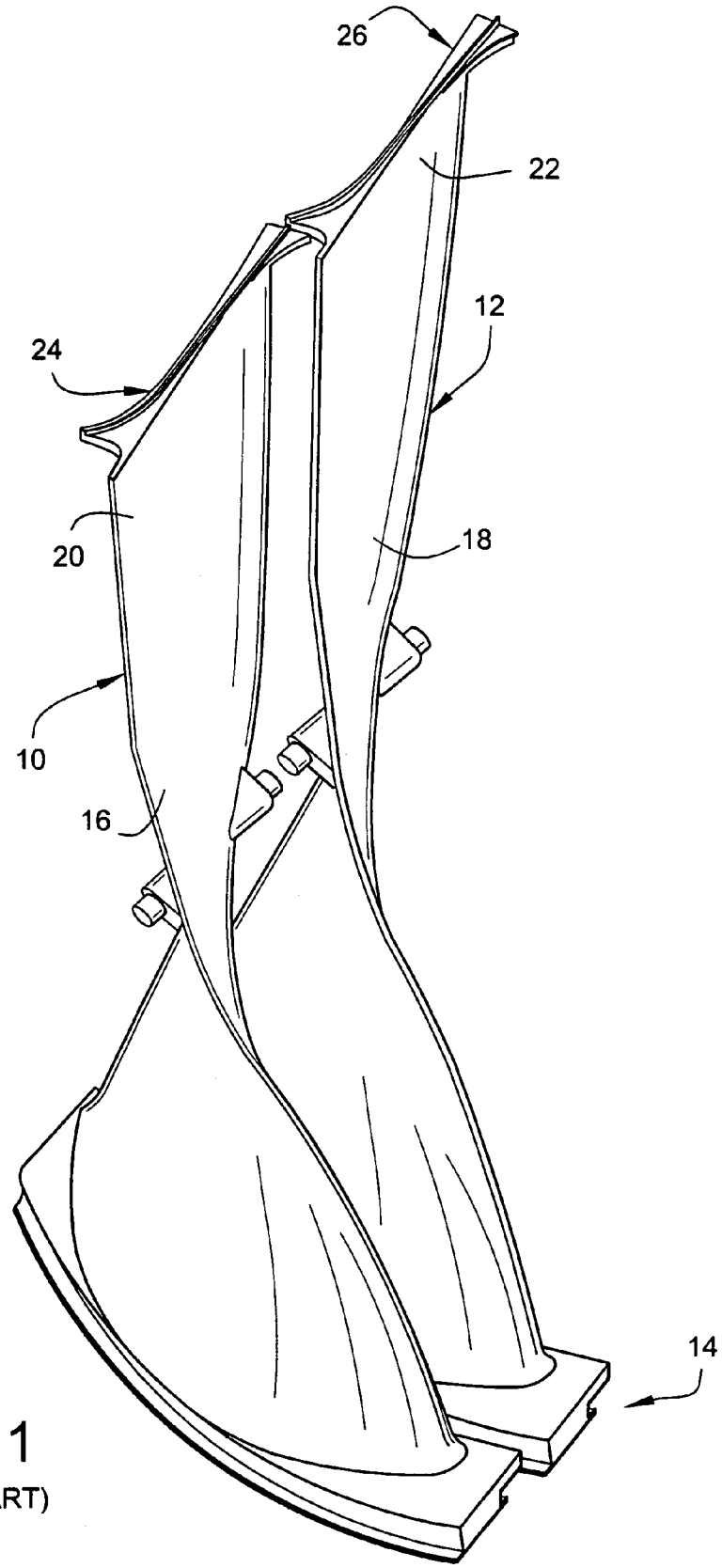
Fig. 1 (PRIOR ART)
FIG. 1 is a partial perspective view of a pair of buckets having integral covers in accordance with a known design.

With reference to FIG. 1, a plurality (two shown) of like turbine blades or buckets 10, 12 are secured to a turbine rotor wheel (not shown) by means of a dovetail or other suitable joint generally indicated at 14. The buckets 10, 12 extend a full 360° about the turbine wheel, thereby forming a "row" of buckets. Each bucket in the row is generally identical, though occasionally the last bucket (or "notch blade") and two buckets adjacent to the notch blade can have some geometrical differences to facilitate assembly. As is well understood, the dovetail or other joints 14 are designed for mating and sliding engagement with a complementary dovetail or other shape formed on the rim of the rotor wheel. The type of bucket dovetail and the manner of loading the buckets onto the wheel may vary and, in any event, is not significant to this invention.

Blade portions 16, 18 of the buckets 10, 12, respectively, extend upwardly from the dovetail or shank portions 19, 21 to respective tips 20, 22. The tips 20, 22 are formed with respective integral covers 24, 26 which couple the entire row of buckets together, substantially 360° about the wheel described in detail.

Figure 2:
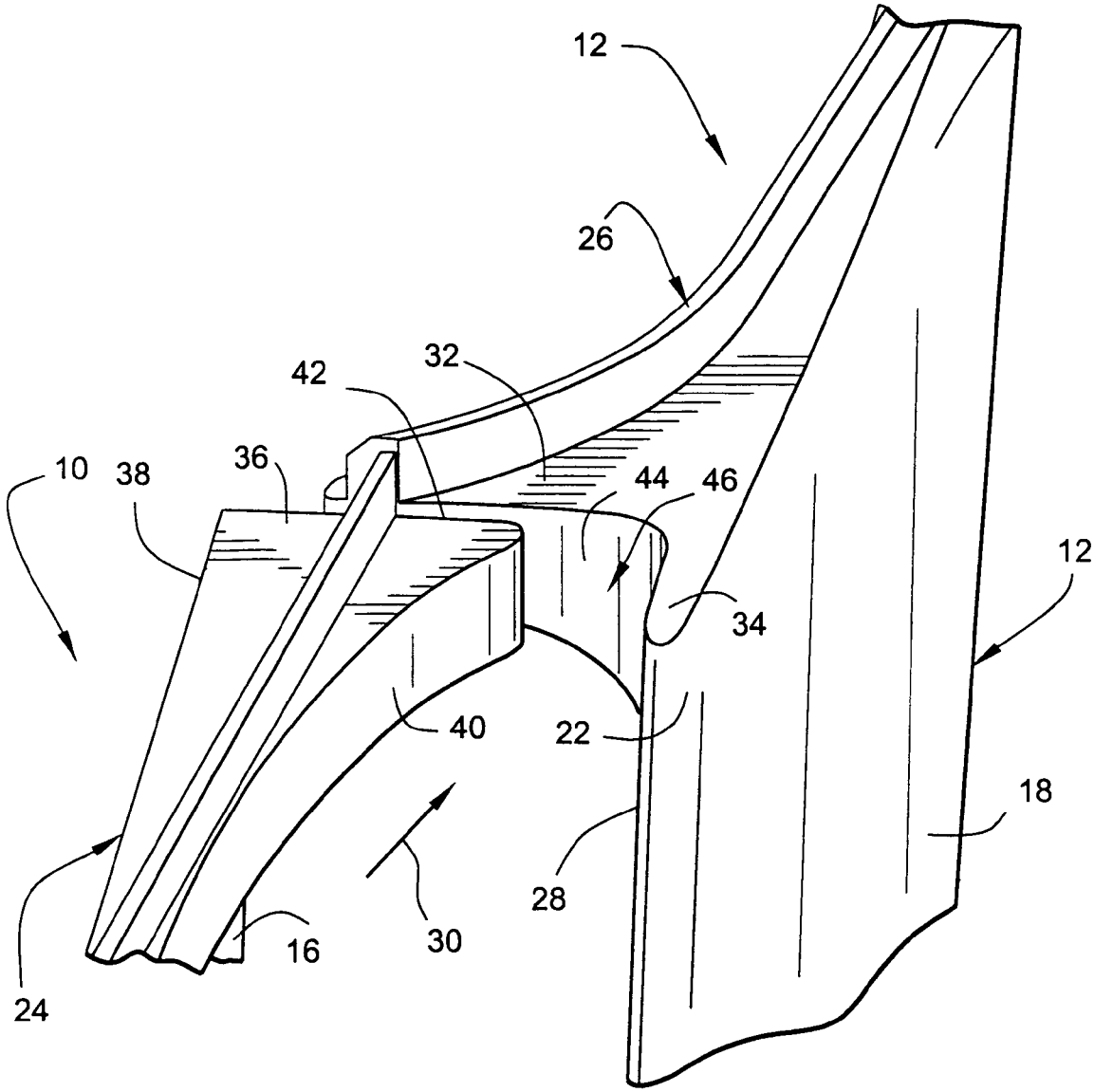
Fig. 2 (PRIOR ART)
FIG. 2 is an enlarged detail taken from FIG. 1.

With reference to FIG. 2, the integral cover 26 is set back from the leading edge 28 of the blade in the direction of steam flow, indicated by the flow arrow 30. Note, however, that the radially outer (or top) surface 32 of the cover is flush with (or lies in the same plane as) the radially outer tip surface 34 of the blade portion 18. The bucket cover 24 of the adjacent blade 10 has a trailing edge portion 36 defined in part by side surfaces 38, 40 and a back face 42. During operation, centrifugal forces cause the back face 42 to engage a generally parallel front face 44 of the cover 26, leaving a pocket area or pocket 46 between the leading edge 28 of bucket 12, front face of the bucket cover 26 and the curved trailing edge side surface 40 of cover 24. This pocket or pocket area is susceptible to moisture collection as described above.

Figure 3:
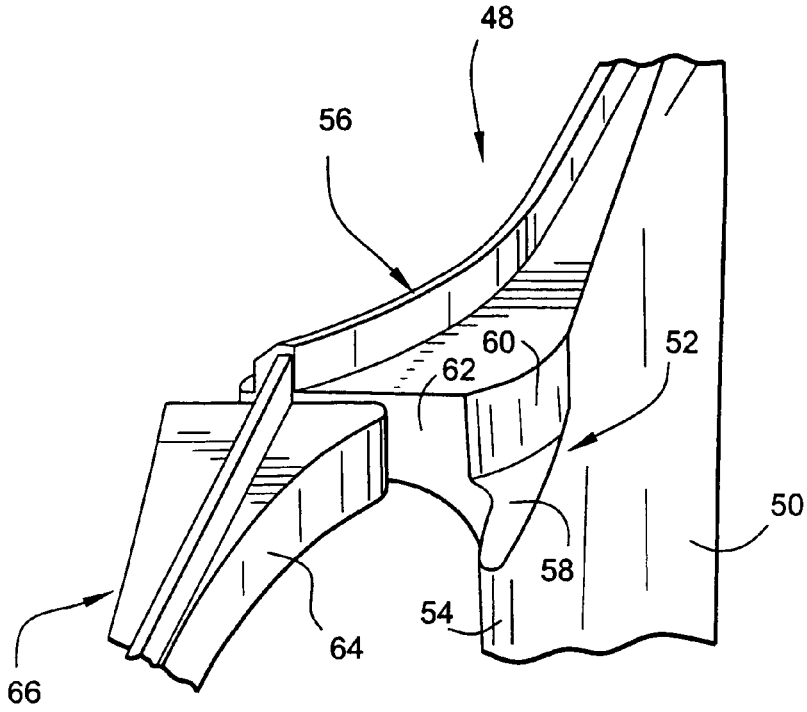
FIG. 3 is a partial perspective view illustrating a bucket tip cover design in accordance with a first embodiment of the invention.

FIG. 3 illustrates a first embodiment or variant of a bucket cover re-design that substantially eliminates the pocket 46 shown in FIG. 2. In this embodiment, the bucket 48 includes a blade portion 50, with a radial step or notch 52 cut into the leading edge 54 of the blade or airfoil portion 50 and associated tip cover 56, such that a portion of the leading edge 54 is radially shortened. Specifically, the step or notch is defined by a radially shortened airfoil surface portion 58 of the leading edge 54 and a curved radial surface 60 cut along the side of the tip cover 56. This cut also reduces the surface area of the front face 62 of the tip cover 56, and thus substantially eliminates the pocket discussed above, while providing a smoother interface for continuity of flow between surface 60 and side surface 64 of adjacent tip cover 66.

Figure 4:
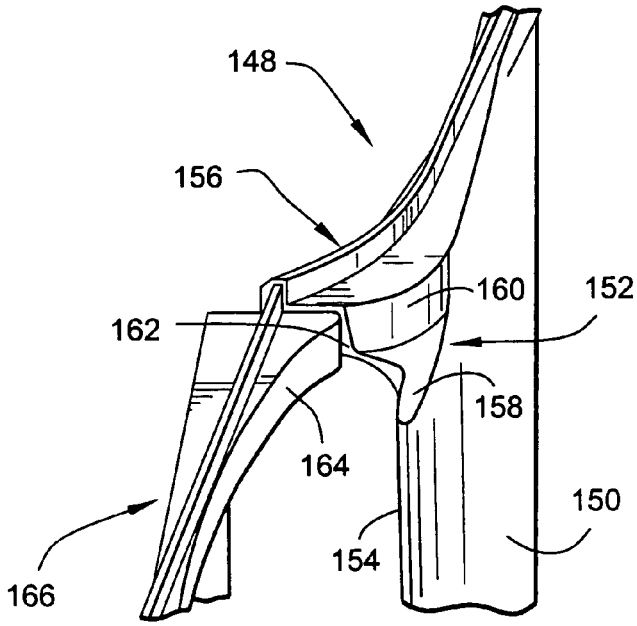
FIG. 4 is a partial perspective view illustrating a bucket tip cover design in accordance with a second embodiment of the invention.

In FIG. 4, a variation of the radial step is illustrated and, for convenience, reference numerals are the same as used in FIG. 3 but with the prefix "1" added. Thus, the bucket 148 includes a blade portion 150, with a radial step or notch 152 cut into the leading edge 154 of the blade portion 150 and associated tip cover 156. The radial cut is defined by radially shortened surface portion 158 and a curved radial surface 60. In this instance, however, the curved radial surface portion 160 of the step is curved more severely to remove additional cover material and substantially eliminate that portion of the front face 162 of the tip cover 156 exposed to wet steam flow. There is now a relatively smooth transition between the curved side surface 164 of the adjacent tip cover 166 and the radial surface portion 160 of the tip cover 156.

The radial shortening of the leading edge 54 or 154 of the blade portion 50 or 150 does not significantly impact performance, and the substantial elimination of the moisture-trapping pocket prevents moisture from collecting and causing potential corrosion damage to the blades and their respective covers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bucket for use on a steam turbine rotor wheel, the bucket comprising a shank portion and an airfoil portion, the airfoil portion having a radially outer tip with an integral tip cover adapted to be engaged, in use, by a similar tip cover on an adjacent bucket, wherein a radial step is formed in said tip cover and said airfoil portion along a leading edge of said airfoil portion.

2. The bucket of claim 1 wherein said step is formed by a first airfoil surface extending in a flow direction away from said leading edge and a second tip cover surface extending radially away from said first airfoil surface.

3. The bucket of claim 2 wherein said second tip cover surface is curved sufficiently away from said leading edge so as to substantially merge into a surface on an adjacent tip cover closest to the leading edge of the bucket.

4. The bucket of claim 1 wherein said leading edge is radially shortened by forming said radial step.

5. A bucket for use on a steam turbine rotor wheel, the bucket comprising a shank portion and an airfoil portion, the airfoil portion having a radially outer tip with an integral tip cover adapted to be engaged, in use, by a similar tip cover on an adjacent bucket, wherein a radial step is formed in said tip cover and said airfoil portion along a leading edge of said airfoil portion; wherein said step is formed by a first airfoil surface extending in a flow direction away from said leading edge and a second tip cover surface extending radially away from said first airfoil surface; and wherein said leading edge is radially shortened by forming said radial step; and further wherein said tip cover is integral with the airfoil portion.

6. The bucket of claim 5 wherein said second tip cover surface is curved sufficiently away from said leading edge so as to substantially merge into a surface on an adjacent tip cover closest to the leading edge of the bucket.

7. A method of eliminating a moisture-trapping pocket between adjacent integral tip covers provided at radially outer ends of respective airfoil portions of turbine buckets comprising:

a) radially shortening leading edges of said turbine buckets airfoil portions and respective integral tip covers to create radial steps between said leading edges and top surfaces of said tip covers; and b) shaping said radial steps such that radial surface portions thereof more smoothly merge with adjacent radial surfaces at trailing edges of adjacent buckets.

* * * * *